United States Patent [19]

Hain et al.

[11] Patent Number: 4,649,832

[45] Date of Patent: Mar. 17, 1987

[54] DRIVE-IN, SELF SERVICE BANKING SYSTEM

[75] Inventors: David A. Hain; Grant G. H. Keir; Alister R. C. McGregor; Alfred J. Hutcheon, all of Dundee, Scotland

[73] Assignee: NCR Corporation, Dayton, Ohio

[21] Appl. No.: 842,963

[22] Filed: Mar. 24, 1986

[30] Foreign Application Priority Data

Nov. 6, 1985 [GB] United Kingdom ..... 8527352

[51] Int. Cl.[4] ..... G07G 5/00

[52] U.S. Cl. ..... 109/24.1; 109/66; 194/350

[58] Field of Search ..... 109/24.1, 45, 48, 66, 109/67, 68; 52/65; 194/350; 186/37

[56] References Cited

U.S. PATENT DOCUMENTS

| | | | |
|---|---|---|---|
| 4,497,261 | 2/1985 | Ferris et al. | 109/66 |
| 4,513,670 | 4/1985 | Berman | 109/24.1 |
| 4,577,562 | 3/1986 | Berman | 109/24.1 |

OTHER PUBLICATIONS

Advertising Sheet by Couvrette Building Systems, marked as Appendix I.

Advertising Sheets (2) by Diebold, marked as Appendix II and Appendix III.

Advertising Sheet by Home Federal Savings and Loan Drive-Up Expand-O ®, marked as Appendix IV.

Advertising Sheet by Couvrette Building Systems, dated Mar. 9, 1984, marked as Appendix V.

*Primary Examiner*—Gary L. Smith

*Assistant Examiner*—Neill Wilson

*Attorney, Agent, or Firm*—Wilbert Hawk, Jr.; Albert L. Sessler, Jr.; Elmer Wargo

[57] ABSTRACT

A self-service banking system includes a walk-in kiosk (12) housing an ATM (10), the ATM including a user console (16) provided in a front wall (17) of the kiosk. The ATM includes a safe (24) in which are housed a currency dispenser unit (20) and a depository unit (22) when the safe is closed. The dispenser and depository units are mounted on the safe door (72), and when the door is fully opened, these units are pivoted through 180 degrees from their home positions to positions outside the safe. The kiosk includes a movable portion (58) which is pivotable through 90 degrees to an extended position in order to accommodate the safe door (72) and the dispenser and depository units (20, 22) when the door is pivoted to its fully open position. The kiosk provides a secure enclosed environment for an authorized person who has opened the safe door (72) for the purpose of carrying out a servicing or note replenishment operation.

10 Claims, 7 Drawing Figures

DRIVE-IN, SELF SERVICE BANKING SYSTEM

BACKGROUND OF THE INVENTION

This invention relates generally to a selfservice, banking system comprising an automated teller machine (ATM), and more particularly, it relates to such a system which is adaptable for use in a drive-in operation which is located on a narrow, island site.

As is well known in operating an ATM, a user inserts a customer identifying card into a card entry slot provided in a user console of the machine and then enters certain data (such as codes, amount of currency to be dispensed or to be paid in, type of transaction, etc.) upon one or more keyboards provided in the console. The machine then processes the transaction, updates the user's account to reflect the current transaction, dispenses cash when requested, and returns the card to the user as part of a routine operation.

ATMs are commonly mounted through a wall of, or located inside, a bank or other building. However, drive-in, self-service banking systems also exist in which an ATM is located at an outside site to facilitate such banking.

One known drive-in, self-service, banking system comprises an ATM housed in a telescopic enclosure or kiosk, with the associated user console of the ATM being provided in a front wall of the kiosk. During normal operation of the ATM, the kiosk has a compact, non-extended configuration, permitting the kiosk to be located on a narrow island site alongside which a vehicle may be parked. When servicing the ATM or when replenishing the notes therein is required, a front portion of the kiosk, together with the ATM, is moved forward relative to the remainder of the kiosk. Such forward movement of the front portion of the kiosk converts the kiosk into a walk-in enclosure into which a person may enter via an access door for the purpose of servicing the ATM or replenishing notes, etc. The enclosure provides protection for the person during such servicing or replenishing. Because it is necessary to move the entire ATM, together with a large portion of the kiosk prior to servicing or replenishing the ATM, this known system has the disadvantage of being expensive, complex and cumbersome.

An object of the present invention is to provide a self-service, banking system which is suitable for use as a drive-in system and which is relatively simple and inexpensive.

According to this invention there is provided a self-service, banking system including a walk-in enclosure including a lockable entry door for gaining access thereto and also including a wall; and an automated teller machine, hereinafter referred to as an ATM, being housed in said walk-in enclosure; said ATM comprising: a user console located in said first wall and including a note delivery aperture; a safe having a lockable door and means for pivoting said lockable door on a vertical axis between locked and opened positions; said safe also including a currency note dispenser unit and means for mounting said currency note dispenser unit on said lockable door for movement therewith; and note delivery means arranged to deliver currency notes from said currency note dispenser unit to said note delivery aperture when said lockable door is in said locked position; said currency note dispenser unit being accessible for servicing and replenishment of currency notes therein when said lockable door of said safe is moved to said opened position; and said lockable door of said safe being substantially perpendicular to said wall when said lockable door is in said locked position.

A preferred embodiment of the invention will now be described by way of example with reference to the accompanying specification, claims and drawing.

DETAILED DESCRIPTION OF THE INVENTION

Figure 1:
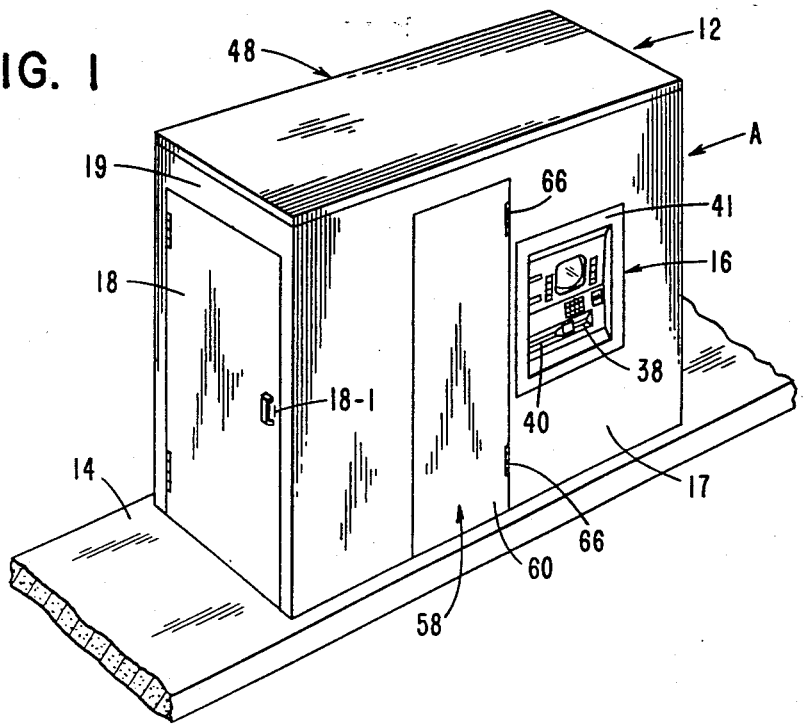
FIG. 1 is a front, perspective view of a self-service, banking system made according to this invention, showing the system being located on a narrow, island site and being housed in a walk-in kiosk.
Figure 2:
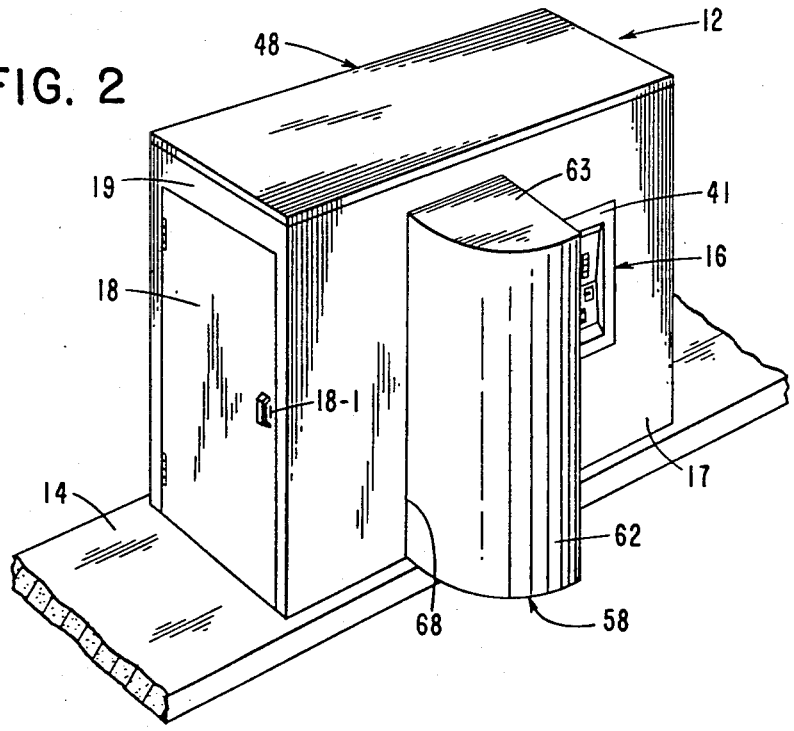
FIG. 2 is a view similar to FIG. 1 showing a movable portion of the kiosk being in an extended position.
Figure 3:
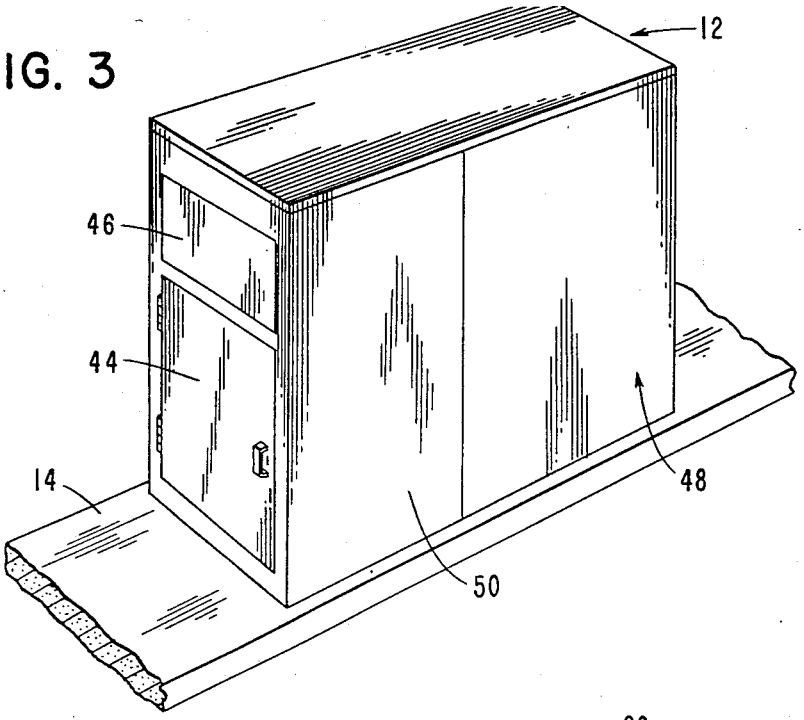
FIG. 3 is a further, perspective view of the rear of the kiosk which is taken from the direction of arrow A in FIG. 1.

The drive-in, self-service banking system shown in FIG. 1 comprises an ATM 10 (FIG. 4) housed in a walk-in enclosure or kiosk 12 of steel construction, the kiosk 12 being mounted on and secured to an elongated concrete base 14. The kiosk 12, for example, has a rectangular, horizontal configuration, typically having a length of 2.8 meters, a width of 0.8 meter, and a height of 2.4 meters. The kiosk 12 is mounted on the base 14 with its front and rear long walls 17 and 48, respectively, extending parallel to and being located slightly inwards from the long edges of the base 14, as shown in FIGS. 1 through 3. A user console 16 of the ATM 10 is mounted in the front wall 17 of the kiosk 12, and a normally-locked door 18 (with lock 18-1) is provided in the left-hand side wall 19 of the kiosk 12. The kiosk 12 is located at an outside site accessible to vehicles, the location of the base 14 being such that a person intending to use the ATM can drive up to the kiosk 12 and park alongside the front wall 17.

The ATM (FIG. 5) includes a currency note dispenser unit 20 and a currency depository unit 22 which are mounted in a safe 24 located inside the kiosk 12. Mounted on the safe 24 and also located inside the kiosk 12 is a housing 26 (FIG. 4) containing conventional units (not shown) including a magnetic card read/write unit, a receipt printer, a receipt transport, and a journal printer. The user console 16 (FIG. 4) includes keyboards 28, a display screen 30, a receipt exit slot 32, a card entry slot 34, and envelope dispenser 36, an envelope entry slot 38 and a currency-note, exit slot 40. A peripheral collar 41 of the user console 16 extends through a mating aperture 42 (FIG. 5) formed in the front wall 17 of the kiosk 12. Power units, alarm units, a controller and modems (not shown) for the ATM 10 are housed in a separate compartment 43 (FIG. 5) of the kiosk 12, the compartment 43 being located at that end of the kiosk 12 opposite the door 18 and being provided with a normally-locked door 44 (FIG. 3) which provides access to the contents of the compartment 43. An air conditioning unit 46 is mounted in an upper part of the compartment 43. In order to facilitate the initial installation of the ATM 10 in the kiosk 12, the rear wall 48 of the kiosk 12 incorporates a panel 50 (FIG. 3) which is secured in place subsequent to the installation of the ATM 10.

A user of the ATM 10 may withdraw cash therefrom or deposit cash therein. In both a cash withdrawal operation and a cash deposit operation, the user first inserts a customer-identifying card into the slot 34 (FIG. 4), and thereafter, the user enters certain data, including his personal identifying number and the amount of money to be withdrawn or to be deposited, upon the keyboards 28. Instructions to the user are displayed on the screen 30, and as part of each operation, a receipt is issued to the user via the receipt exit slot 32. In a cash withdrawal operation, the dispenser unit 20 (FIG. 7) operates so as to present one or more currency notes to the user via the currency note exit slot 40. In a cash deposit operation, the user obtains an envelope from the envelope dispenser 36 (FIG. 4) and places the cash to be deposited in the envelope. Thereafter, the envelope is inserted by the user in the envelope entry slot 38 from which the envelope is withdrawn into an upper housing 52 (FIG. 5) of the depository unit 22 wherein a printer (not shown) prints identifying information on the envelope. The envelope is then deposited in a bin 54 (FIGS. 5, 6) normally located in a lower housing 56 of the unit 22.

Figure 5:
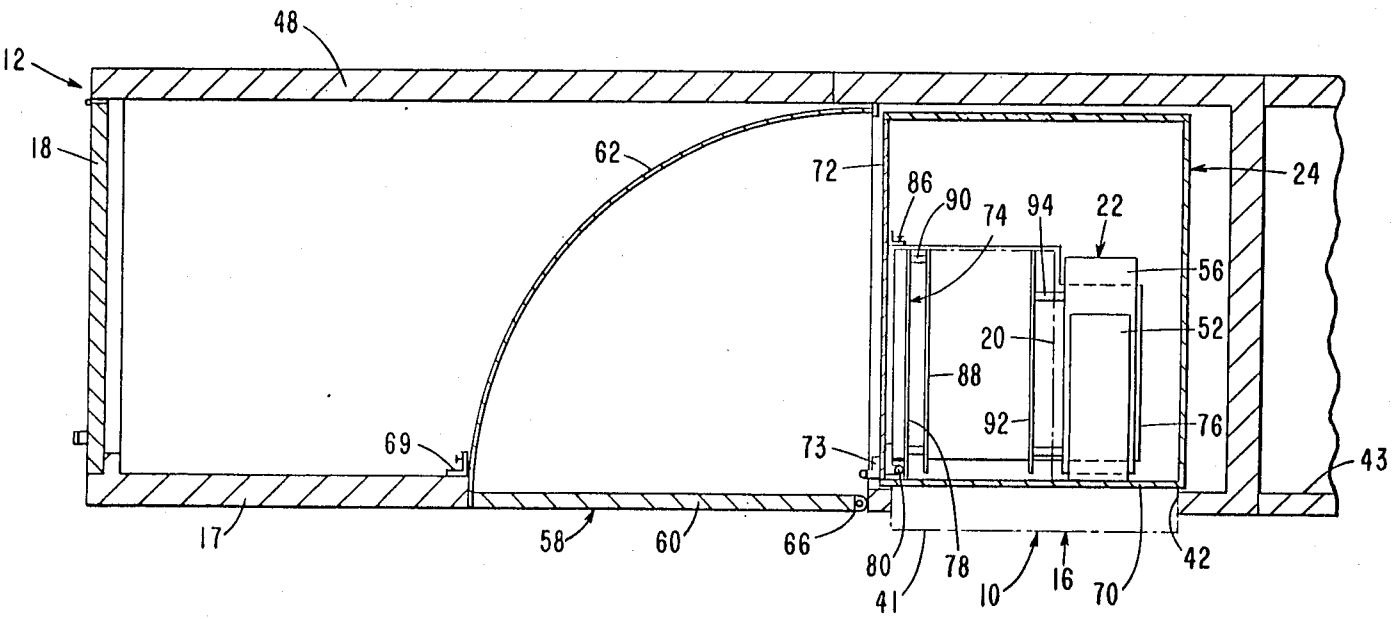
FIG. 5 is a sectional, plan view of the banking system with the movable portion of the kiosk being shown in its home position, the section being taken through a plane corresponding to the line V—V of FIG. 7.

The kiosk 12 (FIGS. 1, 2) includes a movable portion 58 having the configuration of a vertically-extending, quarter cylinder which comprises a planar side wall 60 and a curved side wall 62, the other side (FIG. 6) of the quarter cylinder being open. The quarter cylinder is closed at its upper end by a panel 63, and, if desired, the quarter cylinder may also be closed at its lower end. Normally, the outer surface of the planar wall 60 is coplanar with the outer surface of the front wall 17 of the kiosk 12 as seen in FIGS. 1 and 5, with the curved wall 62 being located inside the kiosk 12. That vertical edge of the planar wall 60 remote from the curved wall 62 is attached to the front wall 17 of the kiosk 12 by means of hinges 66 so that the movable portion 58 is pivotable about a vertical axis located adjacent said edge. The portion 58 is pivotable through 90 degrees between its home position shown in FIGS. 1 and 5 and its fully-extended position shown in FIGS. 2 and 6 in which the portion 58 extends in front of the front wall 17 of the kiosk 12, the portion 58 passing through a mating opening 68 (FIG. 6) formed in the front wall 17. Clamping means 69 are provided inside the kiosk 12 for clamping the portion 58 in its home position. The portion 58 can be released and pivoted or moved to its extended position by a person who enters the kiosk 12 via the door 18.

Figure 6:
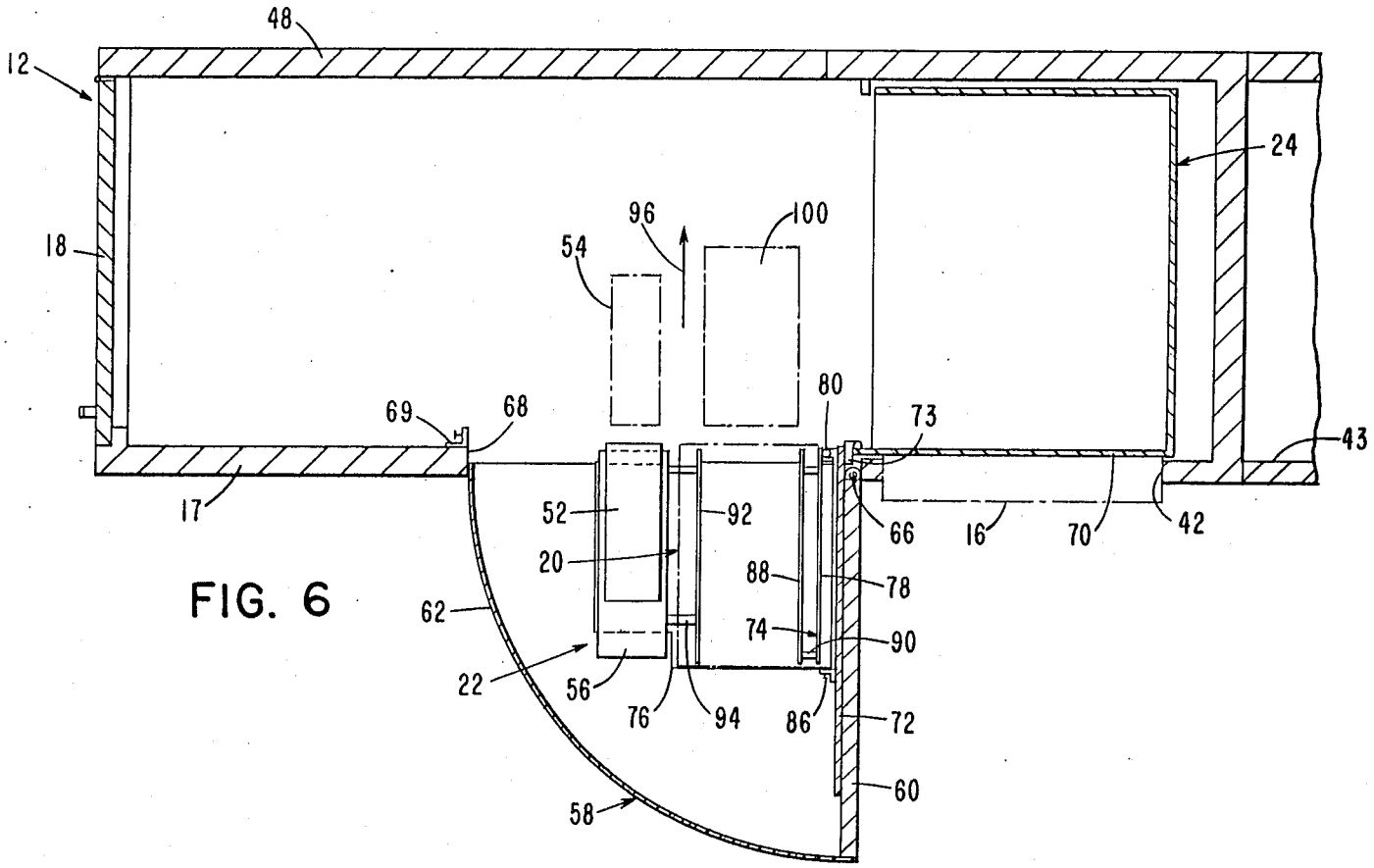
FIG. 6 is a view similar to FIG. 5, but it shows the movable portion of the kiosk in its extended position, and it also shows parts of the ATM being pivoted through 180 degrees from their home positions shown in FIG. 5.

The safe 24 (FIG. 4) of the ATM 10 is located inside the kiosk 12 with its front wall 70 (FIG. 5) positioned adjacent the inner surface of the front wall 17 of the kiosk 12. The safe 24 has a door 72 which, when in its closed position, extends perpendicularly to the front wall 17 of the kiosk 12 and which is provided with hinges 73 at its edge adjacent the front wall 70, so as to permit the door 72, when unlocked, to be rotated to an open position about a vertical axis. Referring particularly to FIGS. 5 and 6, a support frame 74 is attached to the inner surface of the safe door 72, the frame 74 comprising a lower, horizontal platform 76 and a vertical side plate 78 which is integral with the platform 76 and which is normally positioned parallel to and adjacent to the inner surface of the safe door 72. The support frame 74 is attached to the safe door 72 by means of hinges 80 (only one of which is shown) which are located adjacent to the axis of rotation of the door 72 and adjacent to that vertical edge of the side plate 78 which, when the door 72 is closed as shown in FIG. 5, is adjacent to the front wall 17 of the kiosk 12. The opposite edge of the side plate 78 is detachably secured to the safe door 72 by clamping means 86. The dispenser unit 20 and the depository unit 22 are mounted on the platform 76 of the support frame 74. A left-hand, support plate 88 (with reference to FIG. 5) of the dispenser unit 20 is secured to the side plate 78 of the support frame 74 by means of bolts 90, and the lower housing 56 of the depository unit 22 is secured to a right hand support plate 92 of the dispenser unit 20 by means of bolts 94. Apart from the support plates 88 and 92 no details of the dispenser unit 20 are shown in FIGS. 5 and 6. Also, the user console 16 is shown only in dashed outline in FIGS. 5 and 6.

Before the door 72 (FIGS. 4, 5) of the safe 24 can be opened by a person who has entered the kiosk 12, it is first necessary for that person to move the movable portion 58 to its extended position shown in FIGS. 2 and 6. Thereafter, the safe door 72 can be unlocked (via lock 72-1 in FIG. 4) and pivoted through 180 degrees to the position shown in FIG. 6. By virtue of the mounting of the dispenser unit 20 and the depository unit 22 on the support frame 74 attached to the safe door 72, upon the door 72 being pivoted to the fully-open position shown in FIG. 6, the units 20 and 22 pivot together with the door 72 about the axis of rotation of the door 72 so as to be moved fully out of the safe 24 to the positions shown in FIG. 6. Electrical power and control signals for the units 20 and 22 are applied thereto by means of flexible cables (not shown) extending through a wall of the safe 24, these cables permitting the units 20 and 22 to be moved out of the safe 24 as just mentioned.

It will be appreciated that the movable portion 58 of the kiosk 12, having been moved to its extended position, serves to accommodate the units 20 and 22 when moved to the positions shown in FIG. 6. With the units 20 and 22 in these last-mentioned positions, the units 20 and 22 are accessible for servicing. The depository bin 54 can be removed from the lower housing 56 (in the direction indicated by the arrow 96 in FIG. 6), and a reject note bin 98 (FIG. 7) and the currency cassettes 100 can be removed similarly, from the dispenser unit 20. If access to the left-hand side (with reference to FIG. 5) of the dispenser unit 20 is required, then after the safe door 72 has been pivoted to the position shown in FIG. 6, the clamping means 86, attaching an edge of the support frame side plate 78 to the door 72, is released, and the support frame 74, together with the units 20 and 22, is pivoted back through 180 degrees relative to the safe door 72 by means of the hinges 80. The relevant edge of the side plate 78 is reattached to the safe door 72 by means of the clamping means 86 prior to the safe door 72 being closed.

Figure 4:
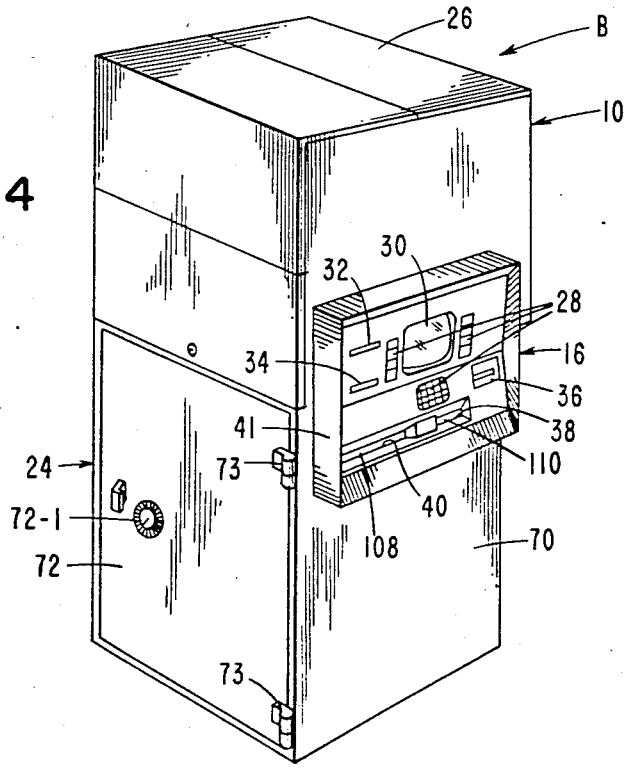
FIG. 4 is a front, perspective view of an ATM used in the banking system.

Upon the safe door 72 being pivoted from its fully-open position back to its closed position shown in FIG. 5, the dispenser unit 20 and the depository unit 22 are moved back into the safe 24, with a currency note outlet 102 (FIG. 7) of the dispenser unit 20 being brought into alignment with a note exit slot 104 in the front wall 70 of the safe 24. Similarly, an envelope entry slot (not shown) in the upper housing 52 of the depository unit 22 is brought into alignment with an envelope entry slot (not shown) formed in the front wall 70 of the safe 24 and aligned with the slot 104. Normally, the currency note outlet 102 is closed by a shutter 108, and the envelope entry slot in the upper housing 52 is closed by a shutter 110 (FIG. 4). The closure and locking of the safe door 72 serves to hold the dispenser unit 20 and the depository unit 22 firmly in their correct operating positions relative to the front wall 70 of the safe 24.

The dispenser unit 20 will now be described in more detail with reference to FIG. 7. A stack of currency notes 112 is held in each of the currency cassettes 100, the cassettes 100 being respectively, slidably mounted in compartments 114 located between the support plates 88 and 92 (FIG. 6). A particular denomination of notes is held in each cassette 100, the denomination being different for each cassette. Each cassette 100 is provided with a pusher plate 116 which is arranged to urge the associated stack of notes 112 from left to right (with reference to FIG. 7) towards pick means 118 which are pivotably mounted on a horizontal shaft 119. When one or more currency notes 112 are to be dispensed from a particular cassette 100 in the course of a cash withdrawal operation, the relevant pick means 118 are pivoted in a counterclockwise direction (as viewed in FIG. 7) so as to draw the lower portion of the first note 112' in the associated stack out of the cassette 100 and into a position where the leading edge of this portion is gripped by a first pair of drive rollers 120. This note 112' is then fed by the drive rollers 120 and by a further series of drive rollers 122 along a feed path 124 to a conventional stacking wheel 126 which rotates continuously in a counterclockwise direction. Means (not shown) are provided along the feed path 124 for detecting any multiple feeding of notes 112 and for detecting any invalid or torn note 112.

The stacking wheel 126 (FIG. 7) comprises a plurality of stacking plates 128 spaced apart in parallel relationship along the stacker wheel shaft 130, each stacking plate 128 incorporating a series of curved tines 132. The tines 132 of the stacking plates 128 pass between fingers 134 of a stripper plate assembly 136 pivotally mounted on a shaft 138. In operation, each note 112 fed along the feed path 124 by the drive rollers 122 enters between adjacent tines 132 of the stacking plates 128 and is carried partly around the axis of the stacking wheel 126, the note being stripped from the wheel 126 by the fingers 134 and being stacked against a belt 140, with a long edge of the note resting on the stripper plate assembly 136. The endless belt 140 cooperates with a pair of endless belts 142 (only one of which is shown) which are pivotally mounted on a shaft 144 and which are normally held in the position shown in FIG. 7. When a bundle of notes 112' (or possibly only a single note) to be dispensed to a user in response to a cash withdrawal request has been stacked against the belt 140, the belts 142 are pivoted in a clockwise direction about the axis of shaft 144 so as to trap the bundle of notes 112' between the belt 140 and the belts 142. It should be understood that in the course of the pivoting movement, the belts 142 pass between adjacent pairs of the stacking plates 128. Assuming that none of the notes in the bundle 112' has been rejected for any reason, the shutter 108 is moved upwardly to an open position, and the belts 140 and 142 are operated so as to drive the bundle 112' to a pair of endless, drive belts 145 and 146. The belts 145 and 146 serve to drive the bundle 112' to a position where the bundle can be collected or grasped by the user of the ATM 10, the bundle extending through the note exit slot 104 in the safe 24 and through the associated note exit slot 40 in the user console 16. The note output end of the pair of belts 145 and 146 constitutes the currency note outlet 102 of the dispenser unit 20. It should be understood that the belts 140 and 142 are mounted in resilient relationship relative to each other and that the belts 145 and 146 are also mounted in resilient relationship to each other. This enables bundles of notes of varying thicknesses to be held between, and fed by, the belts 140 and 142 and the belts 145 and 146.

Figure 7:
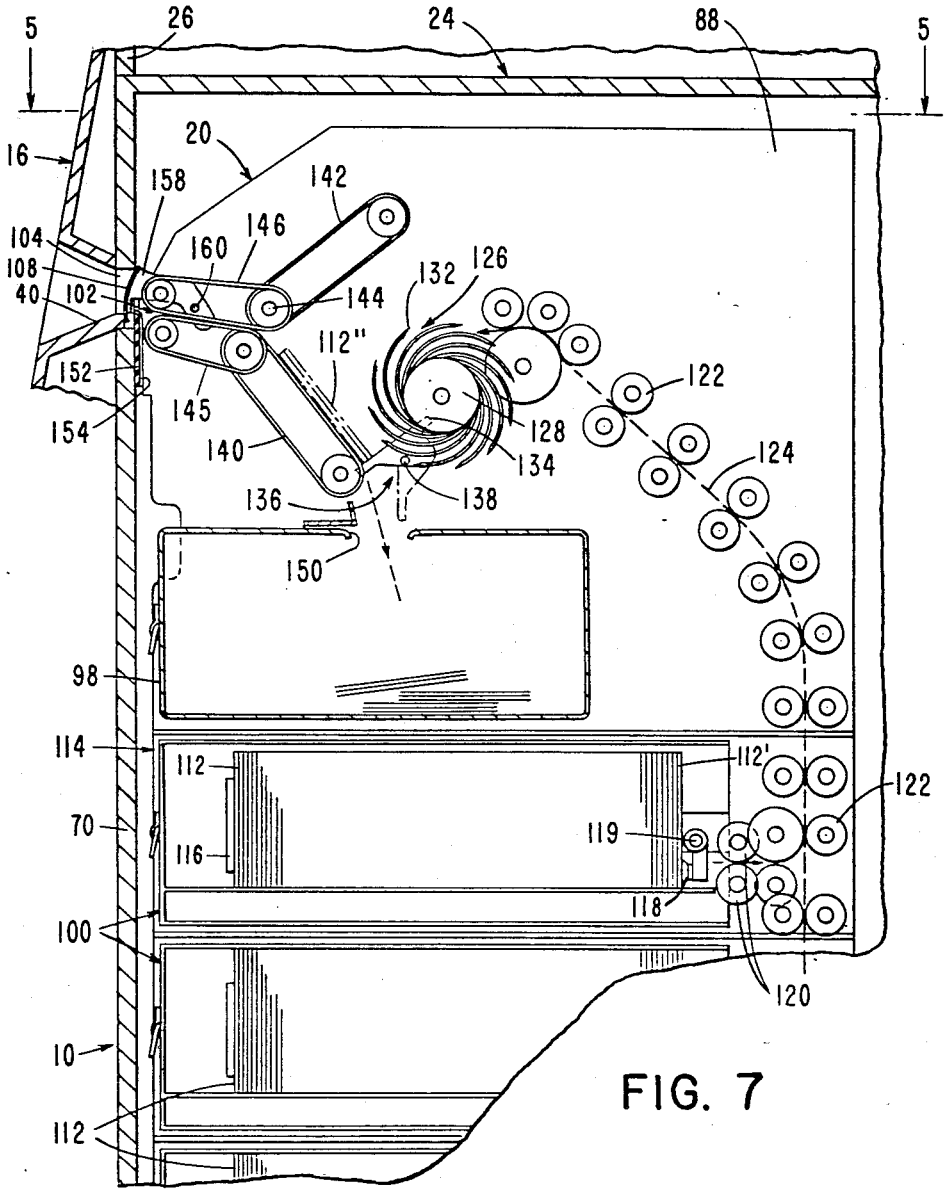
FIG. 7 is an enlarged, part-sectional side elevational view of the ATM, the view being taken from the direction of arrow B in FIG. 4.

If a multiple feeding of notes has been detected in the course of stacking the bundle of notes 112' against the belt 140, or if one or more of the notes in the bundle 112' has or have been rejected for any other reason, then the stripper plate assembly 136 is pivoted into the position shown in dashed outline in FIG. 7. Thereafter, the belts 140 and 142 are operated to feed the bundle 112' in a direction opposite to the normal feed direction, the bundle 112' being deposited in the reject note container 98 via an opening 150 in the top thereof.

The periphery of the note exit slot 40 (FIG. 7) in the user console 16 is sealed to the front wall 70 of the safe 24. A layer 152 of elastomeric material is secured to a front plate 154 of the dispenser unit 20 and is pressed against the inner surface of the front wall 70 of the safe 24 when the dispenser unit 20 is in its operational position with the safe door 72 closed. The layer 152 extends across the entire width of the note exit slot 40 and forms a water-tight seal between the safe wall 70 and the dispenser unit 20. Similarly, a further sealing layer (not shown) of elastomeric material is attached to the front surface of the upper housing 52 of the depository unit 22, this further layer extending across the entire width of the envelope entry slot 38 in the user console 16.

The shutter 108 (FIG. 7) extends between two side arms 158 (only one of which is shown), each of the side arms 158 being pivotally mounted on a shaft 160. Normally, the side arms 158 are in a position in which the shutter 108 completely closes the note exit slot 40, as shown in FIG. 7. In the course of a cash withdrawal operation, the side arms 158 are pivoted in a clockwise direction so as to move the shutter 108 to a position above the currency note outlet 102, thereby permitting the bundle of notes 112' to be presented to the user of the ATM 10 through the note exit slot 40 in the user console 16. Immediately after the bundle of notes 112' has been moved to the position in which the bundle 112' extends through the note exit slot 40, the side arms 158 are pivoted in a counterclockwise direction so as to bring the shutter 108 into resilient engagement with the upper surface of the bundle 112' so as to hold the bundle 112' in the desired position pending withdrawal thereof from the console 16 by the user.

When an ATM servicing, note replenishment, or bin emptying operation is to be carried out, the authorized person who is to carry out such an operation unlocks the door 18, enters the kiosk 12, and relocks the door 18 (FIG. 5) behind him. He then releases the movable portion 58 (via clamping means 69) from its clamped position, pivots the portion 58 to its extended position shown in FIGS. 2 and 6, unlocks the safe door 72, and pivots the door 72, together with the dispenser and depository units 20 and 22, through 180 degrees to the position shown in FIG. 6. The authorized person can then, as may be required, service the dispenser unit 20, having first, if necessary, released the clamping means 86 and pivoted the unit 20 to an appropriate position relative to the safe door 72. The authorized person then may: replenish notes in the dispenser unit 20 by withdrawing one or more of the currency cassettes 100 from the unit 20 and inserting a full cassette 100 in the unit 20 in place of the cassette 100 withdrawn; withdraw the reject note bin 98 from the dispenser unit 20 for the purpose of removing rejected notes from the container 98; and withdraw the depository bin 54 from the depository unit 22 for the purpose of removing envelopes therefrom. It should be understood that, while one or more of the operations just referred to is or are being carried out, the authorized person works in a secure enclosure (the locked kiosk 12) which protects him from possible criminal attack while the safe door 72 is open and from possible adverse outside environmental conditions. After the named operations have been completed, with the currency cassettes 100 and bins 54 and 98 being fully inserted in their correct positions in the units 20 and 22, the authorized person checks that the relevant edge of the support frame 74 is clamped (via clamping means 86) to the safe door 72, and then pivots the door 72 to its closed position, thereby returning the dispenser and depository units 20 and 22 to their operational positions inside the safe 24. The authorized person then locks the safe door 72, pivots the movable portion 58 to its home position shown in FIGS. 2 and 5, clamps the portion 58 in this position via clamping means 69, and leaves the kiosk 12, locking the door 18 behind him. If required, the authorized person can obtain access to the parts of the self-service banking system contained in the compartment 43 (FIG. 6) by unlocking and opening the door 44 (FIG. 3). There is no access to the safe 24 via the compartment 43 and so it is not necessary for the authorized person to be within a secure enclosure while the door 44 is open.

The self-service, banking system described is relatively simple and inexpensive to construct, and it provides a secure closed environment for an authorized person while the safe door 72 is open for the purpose of enabling the person to carry out servicing or other operations with respect to the dispenser and/or depository units 20, 22. Moreover, with the movable portion 58 in its home position, the kiosk 12 has a compact, narrow configuration enabling the kiosk 12 to be located at a narrow site for use of the ATM 10 in drive-in operations.

In a modification of the self-service banking system described above, the dispenser unit 20 is modified so that the currency cassettes 100 and reject note bin 98 are arranged to be withdrawn from the dispenser unit 20 in a direction away from the currency note outlet 102, and the depository unit 22 is modified so that the depository bin is arranged to be withdrawn from the depository unit 22 in a direction away from the envelope entry slot ie., in a direction opposite to arrow 96 in FIG. 6. The dispenser 20 and depository units 22 are again mounted for pivotal movement together with the safe door 60, but with the units modified as mentioned; it is then necessary to pivot the safe door only through 90 degrees from its closed position to enable the cassettes and bins to be withdrawn from the dispenser and depository units and to enable these units to be serviced. Accordingly, with this modification the provision of a movable portion of the kiosk, corresponding to the movable portion 58, may not be necessary.

What is claimed is:

1. A self service, banking system comprising:

a walk-in enclosure including a lockable entry door for gaining access thereto and also including a wall; and an automated teller machine, hereinafter referred to as an ATM, being housed in said walk-in enclosure;

said ATM comprising:

a user console located in said wall and including a note delivery aperture;

a safe having a lockable safe door and means for pivoting said lockable safe door on a vertical axis between locked and opened positions;

said safe also including a currency note dispenser unit and means for mounting said currency note dispenser unit on said lockable safe door for movement therewith; and note delivery means arranged to deliver currency notes from said currency note dispenser unit to said note delivery aperture when said lockable safe door is in said locked position;

said currency note dispenser unit being accessible for servicing and replenishment of currency notes therein when said lockable safe door is moved to said opened position; and said lockable safe door being substantially perpendicular to said wall when said lockable safe door is in said locked position.

2. The self-service, banking system as claimed in claim 1 in which said walk-in enclosure includes a moveable portion and means for mounting said moveable portion on a second vertical axis for pivotal movement between a home position and an extended position, said currency note dispenser unit being accommodated in said moveable portion when said moveable portion is in said extended position and said lockable safe door with said currency note dispenser unit thereon is pivoted through substantially 180 degrees from said locked position.

3. The self-service, banking system as claimed in claim 2 in which said means for mounting said currency note dispenser unit on said lockable door includes means for pivotally mounting said currency note dispenser unit on said lockable safe door for rotation about a third vertical axis between a first position which is adjacent to said lockable safe door when said lockable door is in said locked position and a second position which is substantially 180 degrees from said first position when said lockable safe door is pivoted through said substantially 180 degrees from said locked position.

4. The self-service, banking system as claimed in claim 3 in which said moveable portion is in the form of a quarter cylinder having a planar side wall, a curved side wall joining said planar side wall, and with the remaining side of said quarter cylinder being open; said planar side wall having a first side which is pivotally joined to said walk-in enclosure to pivot on said second vertical axis.

5. The self-service, banking system as claimed in claim 4 in which said moveable portion has an upper end and in which said moveable portion also includes means for closing said upper end.

6. The self-service, banking system as claimed in claim 5 in which said planar side wall of said moveable portion lies in the plane of said wall when said moveable portion is in said home position, and in which said walk-in enclosure also includes clamping means located within said walk-in enclosure for detachably clamping said moveable portion in said home position.

7. The self-service, banking system as claimed in claim 3 in which said currency note dispenser unit has a first side which is adjacent to said first wall of said walk-in enclosure when said lockable door is in said locked position, and in which said first side is exposed when said lockable door is pivoted through said substantially 180 degrees from said locked position to facilitate the loading and unloading of currency note cassettes in said currency note dispenser unit.

8. The self-service, banking system as claimed in claim 7 in which said ATM also includes a currency note depository unit and means for enabling said currency note depository unit to be moved with said currency note dispenser unit.

9. The self-service, banking system as claimed in claim 8 in which said ATM includes operating modules in addition to said safe and said user console, and in which said walk-in enclosure includes a lockable access door for accessing said operating modules from outside said walk-in enclosure.

10. The self-service, banking system as claimed in claim 9 in which said walk-in enclosure is substantially rectangular in cross section having long sides and short sides to facilitate its location on a drive-in site, said wall being one of said long sides.

* * * * *